US008756829B2

(12) United States Patent
Lorion-Fytczyk et al.

(10) Patent No.: US 8,756,829 B2
(45) Date of Patent: Jun. 24, 2014

(54) ROLLER ASSEMBLY FOR A LAUNDRY TREATING APPLIANCE

(75) Inventors: Joli A. Lorion-Fytczyk, Kalamazoo, MI (US); Dengke Shen, Granger, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 897 days.

(21) Appl. No.: 12/796,695

(22) Filed: Jun. 9, 2010

(65) Prior Publication Data

US 2011/0302968 A1 Dec. 15, 2011

(51) Int. Cl.
*F26B 11/02* (2006.01)

(52) U.S. Cl.
USPC ..... 34/601; 384/385

(58) Field of Classification Search
USPC ..... 34/601
See application file for complete search history.

(56) References Cited

U.S. PATENT DOCUMENTS

| | | | | |
|---|---|---|---|---|
| 2,861,355 | A * | 11/1958 | Douglas | 34/82 |
| 3,239,945 | A | 3/1966 | Cobb et al. | |
| 7,140,123 | B2 | 11/2006 | Lee | |

FOREIGN PATENT DOCUMENTS

| | | | |
|---|---|---|---|
| CN | 1970874 | A | 5/2007 |
| DE | 19615822 | C1 | 5/1997 |
| EP | 0802273 | A2 | 10/1997 |
| KR | 1020040012005 | A | 2/2004 |
| KR | 1020050119261 | A | 12/2005 |
| KR | 1020060077343 | A | 7/2006 |
| KR | 1020090126135 | A | 12/2009 |
| WO | 2009061325 | A1 | 5/2009 |

OTHER PUBLICATIONS

Michael et al., May 1997, DE19615822, English machine translation.*
German Search Report for DE102011001948, Feb. 10, 2012.

* cited by examiner

*Primary Examiner* — Jason Ko

(57) ABSTRACT

A roller assembly for a laundry treating appliance, such as a clothes dryer, may have an axle, a wheel having a hub defining an axle opening, a tire coupled with the wheel and having an outer surface in contact with the drum, and a lubricant reservoir configured to communicate with the axle opening such that lubricant in the reservoir may lubricate the axle.

11 Claims, 5 Drawing Sheets

ROLLER ASSEMBLY FOR A LAUNDRY TREATING APPLIANCE

BACKGROUND OF THE INVENTION

A laundry treating appliance, such as a clothes dryer, is a common household device for treating laundry articles according to a programmed cycle. The clothes dryer may include a rotatable drum that receives laundry articles and multiple roller assemblies that may be configured to support and contact the rotatable drum. In some clothes dryers, wearing of the roller assembly, primarily at the interface of a bearing and axle for the roller assembly, may generate an undesirable noise.

BRIEF DESCRIPTION OF THE INVENTION

The invention relates to a roller assembly for a laundry treating appliance, such as a clothes dryer, having an axle, a wheel having a hub defining an axle opening in which the axle is received, and a lubricant reservoir formed in the hub and having an outlet in communication with the axle opening such that any lubricant retained in the reservoir may exit the outlet and provide lubricant to the roller assembly.

DESCRIPTION OF EMBODIMENTS OF THE INVENTION

Figure 1:
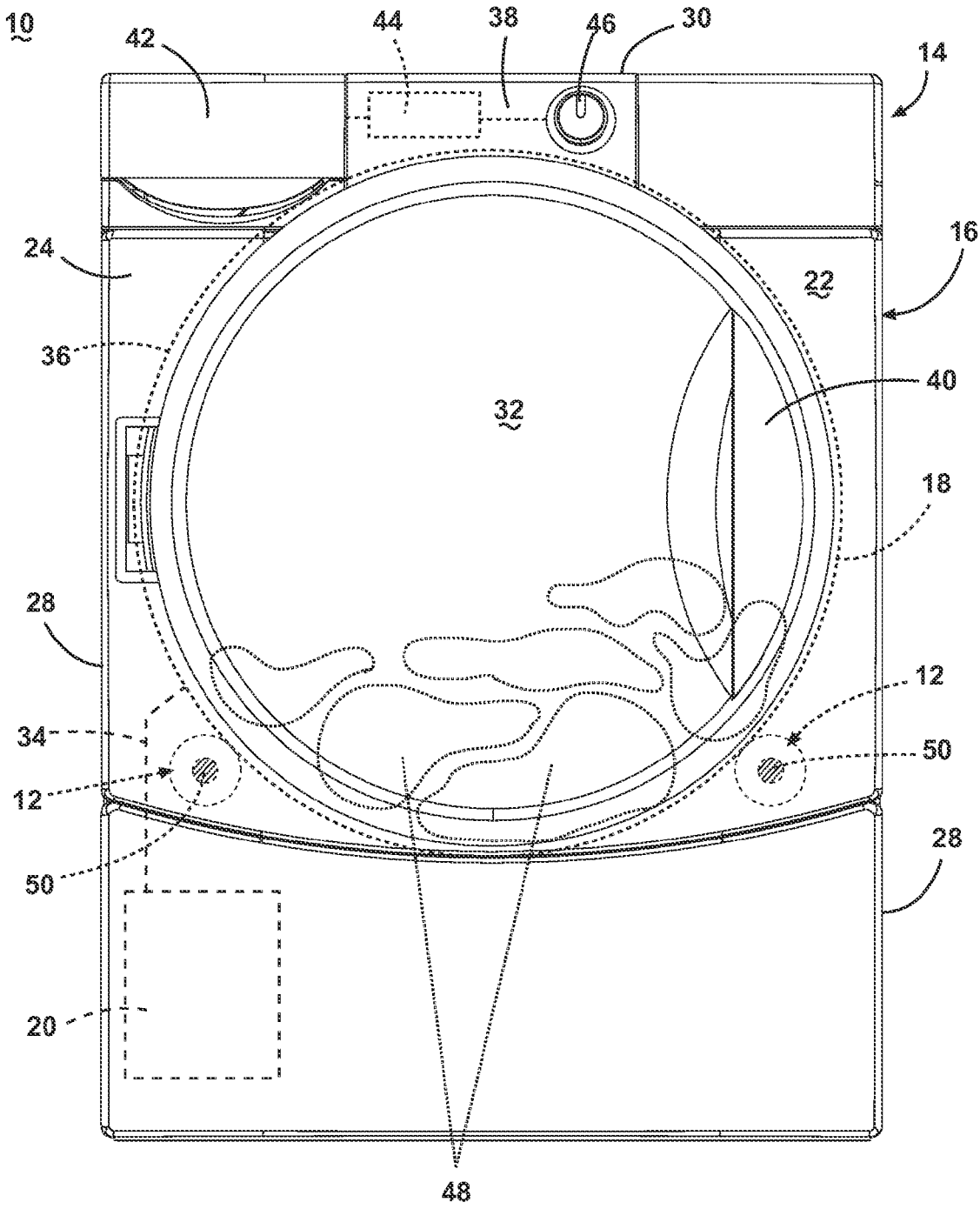
FIG. 1 is a front perspective view of a laundry treating appliance in the form of a clothes dryer having multiple roller assemblies according to a first embodiment of the invention.

FIG. 1 is a front perspective view of a laundry treating appliance 10 in the form of a clothes dryer 14 having multiple roller assemblies 12 according to one embodiment of the invention. As illustrated herein, the laundry treating appliance 10 may be a clothes dryer 14. While the roller assemblies 12 may be shown and described for use with a clothes dryer 14, the laundry treating appliance 10 may be another type of laundry treating appliance, non-limiting examples of which include a dispensing dryer, a combination washing machine and dryer, and a tumbling refreshing and/or revitalizing machine.

The clothes dryer 14 may include a cabinet 16, a drum 18 supported by and in contact with the multiple roller assemblies 12, and a motor 20. The cabinet 16 may define an interior 22 of the clothes dryer 14, and may be defined by a front wall 24, a rear wall (not shown), a pair of side walls 28 supporting a top wall 30. The drum 18 may be located within the interior 22 of the clothes dryer 14 and defines a laundry treating chamber 32, and may be rotatable about an axis of rotation. The motor 20 may be operably coupled to the drum 18 by an electrical connector 34 such as an electrical cable to provide electrical power to the drum 18 to rotate the drum 18 about the axis of rotation according to a pre-programmed operational cycle. The multiple roller assemblies 12 may be in contact with at least a portion of an exterior surface 36 of the rotatable drum 18 to support the drum 18.

The clothes dryer 14 may further include a user interface 38, a door 40, and a dispensing drawer 42. The user interface 38 may include a controller 44 and a parameter selector 46 in the form of a knob. The controller 44 may be operably coupled with the parameter selector 46 to selectively operate a pre-programmed operational cycle. The door 40 may be hingedly coupled with the cabinet 16 and configured to selectively close an opening to the laundry treating chamber 32. The dispensing drawer 42 may be operably coupled with the controller 44 such that the dispensing drawer 42 may selectively dispense a pre-determined dose of at least one treating chemistry according to the operational cycle selected by a user.

Laundry articles 48 may be positioned inside the drum 18 of the clothes dryer 14. Then, the door 40 to the laundry treating chamber 32 may be closed and the operational cycle may be performed to dry the laundry articles 48. When the drum 18 rotates about the axis of rotation according to the operational cycle, the roller assemblies 12 may also rotate about an axle 50 through contact with the exterior surface 36 of the drum 18.

Figure 2:
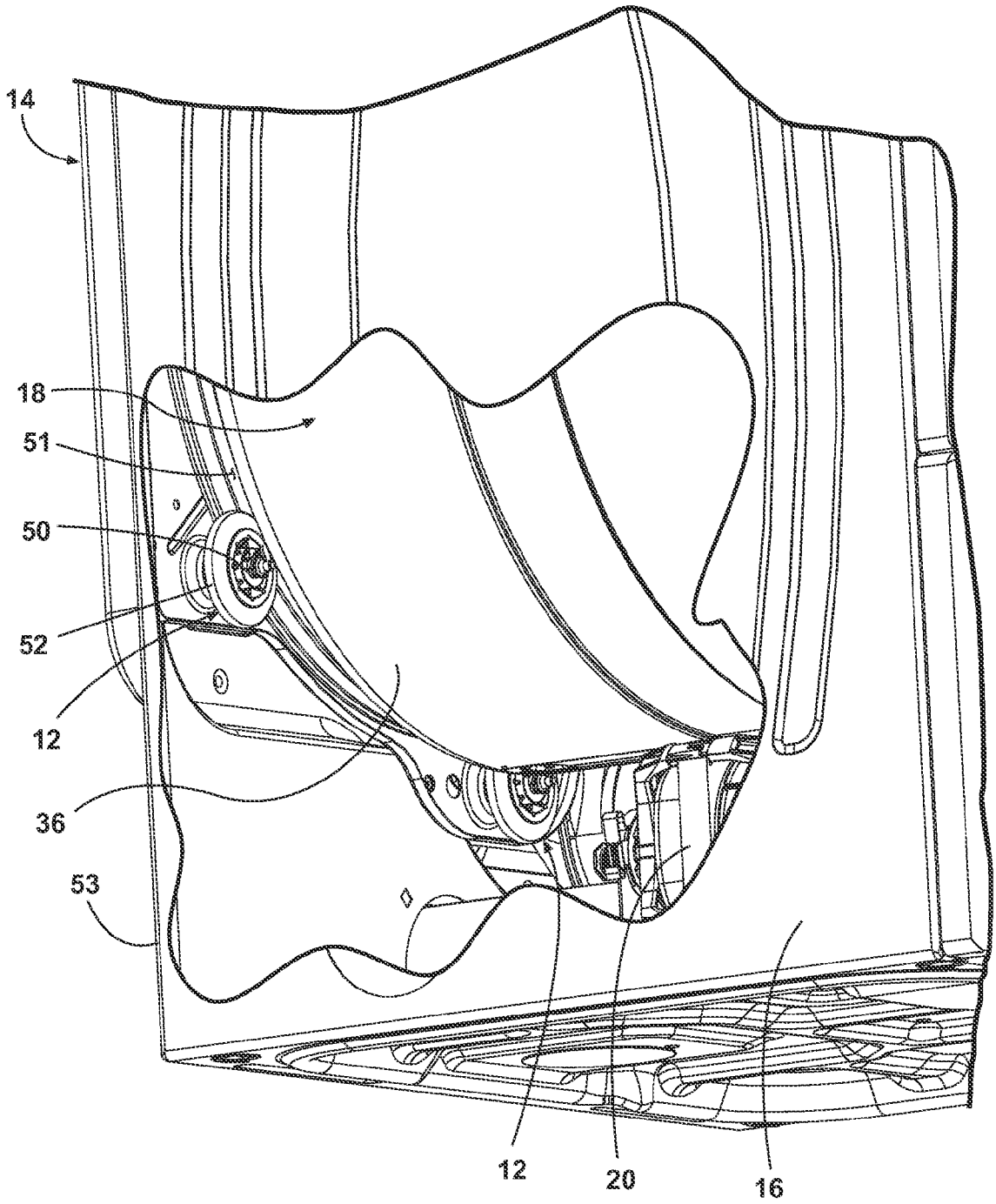
FIG. 2 is a partial perspective view of the clothes dryer of FIG. 1, with a portion of the clothes dryer cut away to show the multiple roller assemblies.

FIG. 2 is a partial perspective view of the clothes dryer 14, with a portion of the clothes dryer 14 cut away to show the multiple roller assemblies 12. As illustrated, each of the roller assemblies 12 may have a support roller 52 received by the axle 50. One end of the axle 50 may be operably coupled with a portion of the cabinet 16 such that the roller assembly 12 may rotate and/or support the rotatable drum 18 while the exterior surface 36 of the drum 18 contacts the roller assembly 12 while the axle 50 remains stationary. As illustrated, the support roller 52 may be positioned such that the support roller 52 may be received in a groove 51 that may be formed on the exterior surface 36 of the rotatable drum 18.

As illustrated, two roller assemblies 12 are disposed with a predetermined spacing to a rear wall 53 of the cabinet 16 to support the rotatable drum 18. In another embodiment, any number of roller assemblies may be operably coupled to a portion of the cabinet 16, such as the front wall 24, the rear wall 53, or either side walls 28 of the clothes dryer 14 shown in FIGS. 1 and 2.

Figure 3:
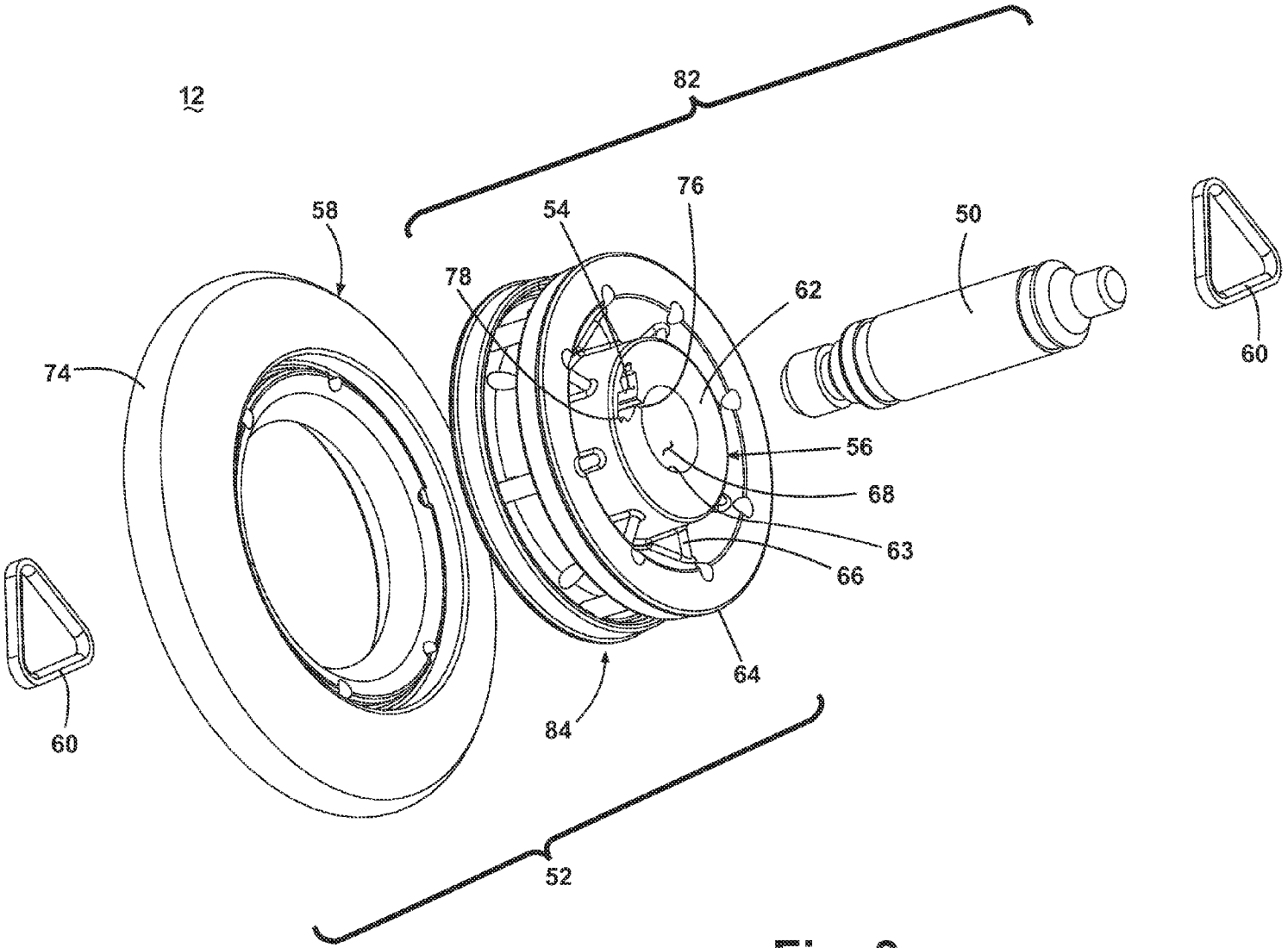
FIG. 3 is an exploded view of one of the roller assemblies of FIG. 2.

FIG. 3 is an exploded view of one of the roller assemblies 12 of FIG. 2. It is noted that the multiple roller assemblies 12 of FIG. 1 may be substantially identical to each other. The roller assembly 12 may include the support roller 52, the axle 50, and a lubrication reservoir 54. The support roller 52 may include a wheel 84 having a hub 56 and a tire 58 mounted to the wheel. The lubrication reservoir 54 may be formed in the hub 56. The roller assembly 12 may further optionally include at least one tri-ring clip 60.

The axle 50 may be received by the hub 56 to rotatably support the support roller 52 about the axle 50. The axle 50 may generally be formed as a cylinder having a constant cross-sectional area or a varying cross-sectional area. The axle 50 may be manufactured from a metallic or metallic alloy material. The axle 50 and the wheel 84 together may define a wheel assembly 82 which may mount the tire 58 to support the rotatable drum 18.

The hub 56 may include a central collar 62 and may define an axle opening 68 in which the axle 50 may be received for relative rotation between the axle 50 and the hub 56. The diameter of the axle opening 68 may be sized such that the axle 50 may rotate when the axle 50 may be received by the central collar 62. The central collar 62 may have an inner bearing structure, such as a bearing surface 63 that borders the axle opening 68 and may further contact the axle 50 when the axle 50 may be received by the central collar 62. As such, the central collar 62 may be thought of as a bearing. The central collar 62 may be formed, partially or entirely, from a non-metallic material. The non-metallic material may include nylon, acetal copolymer, or any other suitable plastic materials.

The wheel 84 may further include a rim 64 and multiple spokes 66 extending generally between the hub 56 and the rim 64. The rim 64 may be located about the outer perimeter of the hub 56 to circumscribe the hub 56 and may be configured to mount the tire 58. The spokes 66 may be coupled between the hub 56 and the rim 64 to impart mechanical stability to the support roller 52.

The tire 58 may have an outer surface 74 that may be in contact with the exterior surface 36 of the drum 18. The tire 58 may be operably coupled with the wheel 84 such that the tire 58 may be mounted to the wheel 84 and may be prevented from being disengaged from the wheel 84. The tire 58 may be at least partially mounted on the rim 64. While the tire 58 is shown in FIG. 3 as being a separate piece from the wheel 84, in another embodiment, the tire 58 may be integrally formed with the wheel 84 to from a one-piece support roller 52. For example, the tire 58 and wheel 84 may be a single molded piece.

The lubricant reservoir 54 may have an outlet 76 and a reservoir 78 in fluid communication with the outlet 76. The lubricant reservoir 54 may be located within the hub 56, such as within the central collar 62 of the hub 56 as illustrated, such that the outlet 76 may be in communication with the axle opening 68. In another embodiment, not shown, more than one lubricant reservoir 54 may be formed within the hub 56 with a predetermined spacing between the lubricant reservoirs 54.

As illustrated, two tri-ring clips 60 are provided and may optionally be coupled to the axle 50 on either side of the support roller 52 such that the support roller 52 may rotate about the axle 50 at a predetermined position between the tri-ring clips 60.

Figure 4:
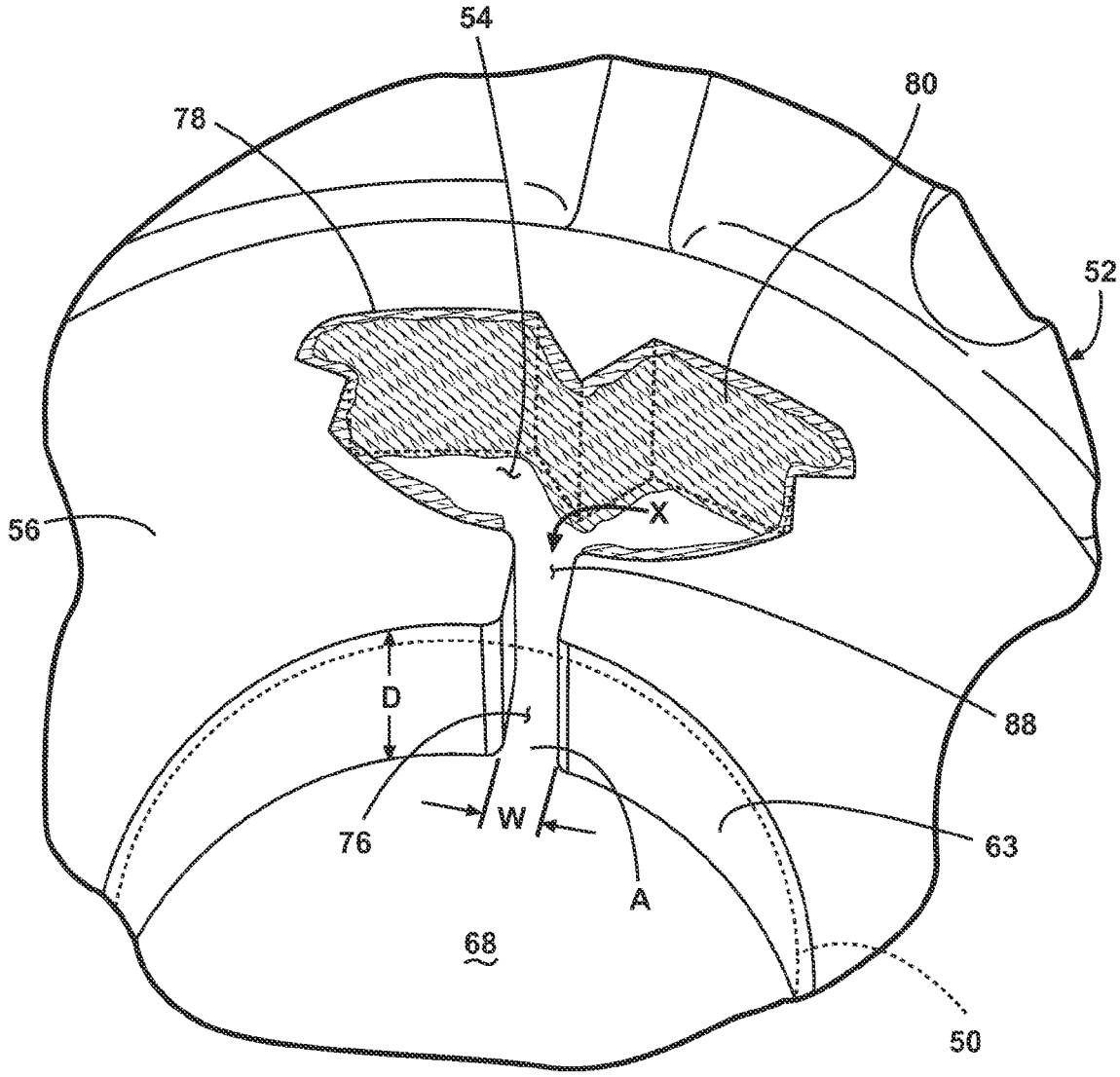
FIG. 4 is a detailed partial perspective view of a lubrication reservoir of the roller assembly of FIG. 3.

FIG. 4 is a detailed partial perspective view of the lubrication reservoir 54 of the roller assembly 12 of FIG. 3. The lubrication reservoir 54 may store or hold a lubricant 80 in the reservoir 78. The outlet 76 of the lubricant reservoir 54 may be configured such that lubricant 80 may exit the outlet 76 to communicate with the axle 50, shown in phantom line, which may be received by the axle opening 68. A channel 88 may extend between the reservoir 78 and the outlet 76, such that the outlet 76 may be defined as the opening through which lubricant may exit the channel 88. The cross-sectional area A of the outlet 76 may be shown to be related with the depth D of the hub 56 and an opening width W by the following equation (1):

$$A\ (\mathrm{mm}^2)=D\ (\mathrm{mm})\times W\ (\mathrm{mm}) \quad (1)$$

The cross-sectional area A for the outlet 76 of the lubricant reservoir 54 may range from approximately 15 $mm^2$ to 27 $mm^2$. More specifically, the average cross-sectional area A of the outlet 76, which may be based on the cross-sectional area A of the outlet 76 of more than one lubricant reservoir 54, may be about 21 $mm^2$.

The outlet 76 of the lubrication reservoir 54 may operably communicate with the channel 88 to receive the lubricant 80 that may be stored in the reservoir 78. The channel 88 may be operably coupled with the outlet 76 and the reservoir 78 such that the lubricant 80 in the reservoir 78 may be received by the channel 88, and then may exit the outlet 76. The channel 88 may have a substantially identical cross-sectional area as the outlet 76 or may have a varying cross-sectional area along the length of the channel 88.

The lubrication reservoir 54 may be formed in the hub 56 by cutting out a portion of the hub 56. After the lubrication reservoir 54 is made, the lubricant 80 may be filled in the reservoir 78 using any appropriate fixture. The viscosity of the lubricant 80 in the reservoir 78 may range from about 450 to 600 when measured at a temperature of 37.8 degrees Celsius under the ASTM method D-88 (Test for Saybolt Viscosity).

When the support roller 52 rotates about the axle 50, the axle 50 may be lubricated by the direct contact between the axle 50 and the lubricant 80 that exits the outlet 76 through the channel 88 of the lubricant reservoir 54. Alternatively, gravitational force may be exerted on the lubricant 80 to draw it out of the outlet 76 to lubricate the axle 50. Depending on the rotational speed of the support roller 52, the force of gravity may push the lubricant 80 down, as shown as by arrow X through the channel 88 and the outlet 76 to the axle opening 68, and ultimately to the surface of the axle 50. Since there may be a layer of lubricant 80 at the rotational interface between the hub 56 and the axle 50, the axle 50 may be provided with lubrication continuously throughout the life of the roller assembly 12, which may reduce the operational noise of the roller assembly 12 and wear between the hub 56 and the axle 50.

As illustrated in FIG. 4, when viewed from the front, the shape of the reservoir 78 may include multiple linear and non-linear walls or sides that may be configured to be similar to a symmetrically disposed, two-way branch. However the shape of the reservoir 78 may not be limited by the shape shown in the embodiment of FIG. 4.

Figure 5A:
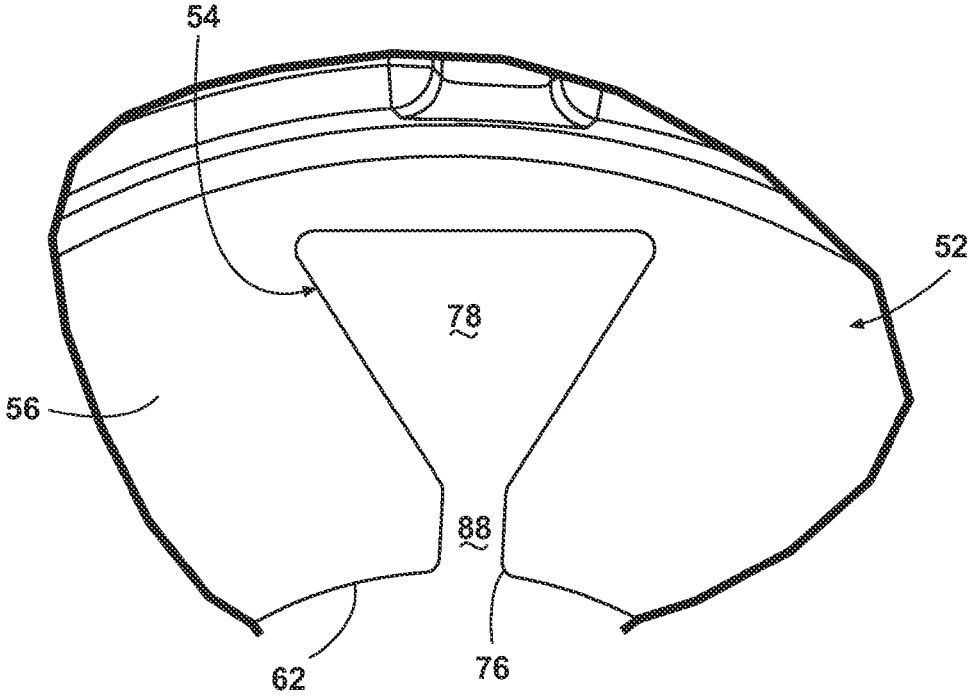
FIGS. 5A and 5B are partial front perspective views of lubrication reservoirs according to a second and a third embodiment of the invention, respectively.
Figure 5B:
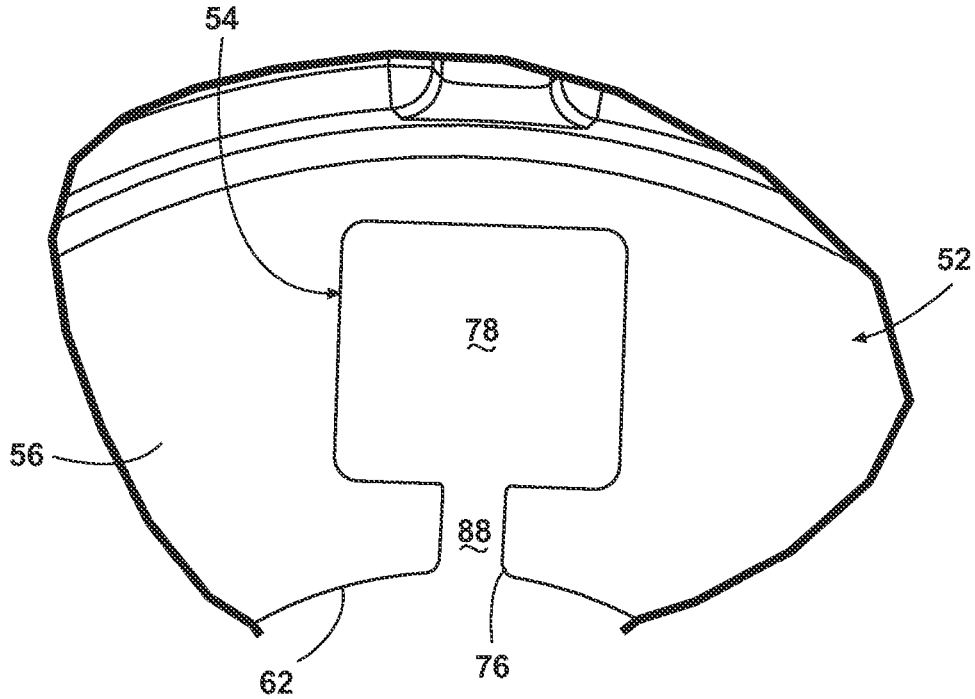

FIGS. 5A and 5B are partial front perspective views of lubrication reservoirs 54 according to a second and a third embodiment of the invention, respectively. Similar elements in common with the first embodiment of the invention shown in FIG. 4 are referred to with the same reference numerals. FIGS. 5A and 5B represent other non-limiting embodiments of the shape of the reservoir 78. In FIG. 5A, the reservoir 78 is shown as having a generally triangular shape, but other shapes are possible. In FIG. 5B, the reservoir 78 is shown as having a generally rectangular shape, but other shapes are possible. Other examples of the shape of the reservoir 78 may include, but are not limited to, any configuration having combination of any number of linear elements and any number of non-linear elements.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance comprising:

a cabinet defining an interior;

a drum located within the interior and rotatable about an axis of rotation;

a motor operably coupled to the drum to rotate the drum about the axis of rotation; and a roller assembly supporting an exterior surface of the drum and comprising:

a non-rotating axle;

a wheel comprising a hub having a circumferential bearing surface defining a circular axle opening in which the axle is received to rotably mount the wheel to the axle;

a tire coupled with the wheel and having an outer surface in contact with the drum; and a lubricant reservoir located within the hub and having an outlet located on the bearing surface to be in communication with the axle opening such that at least some of a lubricant retained in the reservoir may exit the outlet and lubricate the axle, wherein rotation of the wheel about the axle results in a corresponding rotation of the outlet about the axle to deliver lubricant from the lubricant reservoir about the axle.

2. The laundry treating appliance of claim 1 wherein the hub comprises a non-metallic portion defining the axle opening.

3. The laundry treating appliance of claim 2 wherein the non-metallic portion forms the bearing surface.

4. The laundry treating appliance of claim 1 wherein the hub comprises a central collar defining the axle opening, with the lubricant reservoir located within the central collar.

5. The laundry treating appliance of claim 4 wherein the wheel further comprises a rim circumscribing the collar, with the rim mounting the tire.

6. The laundry treating appliance of claim 1 wherein the outlet has a cross-sectional area of 15 mm2 to 27 mm2.

7. The laundry treating appliance of claim 6, further comprising grease in the lubricant reservoir having a viscosity of about 450 to 600 at 37.8 degrees Celsius under the ASTM method D-88.

8. The laundry treating appliance of claim 7 wherein the average cross-sectional area of the outlet is about 21 mm2.

9. The laundry treating appliance of claim 8 wherein the grease has a viscosity of 450 to 600 at 37.8 degrees Celsius under the ASTM method D-88.

10. The laundry treating appliance of claim 1 wherein the tire and the wheel are integrally formed as one piece.

11. The laundry treating appliance of claim 1 wherein the laundry treating appliance comprises a clothing dryer.

* * * * *